US005529501A

United States Patent [19]

Maruyama

[11] Patent Number: 5,529,501

[45] Date of Patent: Jun. 25, 1996

[54] ELECTRONIC WRITING/ERASING APPARATUS FOR REWRITABLE HEAT SENSITIVE SHEET

[75] Inventor: Satoru Maruyama, Iruma, Japan

[73] Assignee: Casio Computer Co., Ltd., Tokyo, Japan

[21] Appl. No.: 357,864

[22] Filed: Dec. 16, 1994

[30] Foreign Application Priority Data

Dec. 28, 1993 [JP] Japan ..... 5-349184

[51] Int. Cl.[6] ..... B43L 1/00

[52] U.S. Cl. ..... 434/408; 434/365; 434/410; 401/2; 345/179; 374/183

[58] Field of Search ..... 434/81, 85, 365, 434/408, 410, 413, 417; 401/2, 194; 345/1, 179, 180–183, 901, 903; 178/18, 19; 346/33 TP; 358/472, 473; 347/171; 382/314; 374/183, 186

[56] References Cited

U.S. PATENT DOCUMENTS 3,886,311 5/1975 Rodgers et al. ..... 401/194 X
4,176,273 11/1979 Fujie et al. ..... 401/2 X
4,523,235 6/1985 Rajchman ..... 358/472
4,758,846 7/1988 Watkins ..... 401/2 X
5,467,102 11/1995 Kuno et al. ..... 345/1
5,475,401 12/1995 Verrier et al. ..... 345/179

FOREIGN PATENT DOCUMENTS 6-183193 7/1994 Japan ..... 401/2

*Primary Examiner*—Joe Cheng
*Attorney, Agent, or Firm*—Frishauf, Holtz, Goodman, Langer & Chick

[57] ABSTRACT

First and second switches, which are to be operated by a user, are provided on a pen-shaped housing. A first heat generating head for writing an image on a rewritable heat sensitive sheet is arranged at an end of a tapered end portion of the pen-shaped housing, and a second heat generating head, for generating heat at a temperature which is different from a temperature of heat generated from the writing head, is arranged at flat another end of the pen-shaped housing. The writing head generates heat only when the first switch is turned on, and the erasing head generates heat only when the second switch is turned on, so that the erasing head erases the image which have been written on the heat sensitive sheet from the sheet.

16 Claims, 11 Drawing Sheets

ELECTRONIC WRITING/ERASING APPARATUS FOR REWRITABLE HEAT SENSITIVE SHEET

BACKGROUND OF THE INVENTION

1. Field of the Invention

The present invention relates to an electronic writing/erasing apparatus for writing an image on a rewritable heat sensitive sheet.

2. Description of the Related Art

As a handwritten image display apparatus, a black or green board, a white board, a meeting board (on which disposable exclusive writing papers are put), and the like are well known. These boards are used to display an attendance of a meeting with a handwritten image which expresses the contents and progress of the proceedings of the meeting.

While the black or green board has an advantage that it can be used repeatedly by erasing a hand written image such as characters or numerals written thereon, it has a disadvantage that user's hands are soiled with a writing equipment such as a chalk, powder of the chalk is not good for user's health, and the written image tends to be blurred and to be disappeared.

Though the white board has the same advantage as that of the black or green board, it has a disadvantage that, since a marker pen used as a writing equipment uses a volatile ink, the lifetime of the marker pen is short, and thus the marker pen tends to be useless shortly.

The meeting board has a disadvantage that it uses disposable exclusive papers and it waste papers.

In order to eliminate the above disadvantages, a handwritten image display apparatus which can be used repeatedly, handled easily, not waste a recording medium such as papers, always written clearly an image such as characters and numerals thereon, not soil user's hands with a writing equipment and not deteriorate user's health are required.

SUMMARY OF THE INVENTION

An object of the present invention is to provide an electronic writing/erasing apparatus which is used in combination with a rewritable heat sensitive sheet, can be used repeatedly, handled easily, not waste a recording medium such as papers, always used to write clearly an image such as characters and numerals thereon, not soil users' hands and not deteriorate user's health.

In order to achieve the above described object of this invention, an electronic writing/erasing apparatus according to one aspect of the present invention, for a rewritable heat sensitive sheet, comprises:

a pen-shaped housing;

a heat generating head housed in the housing, for generating heat to write an image on the rewritable heat sensitive sheet; and a heat generating head housed in the housing, for generating heat at a temperature which is different from a temperature of heat generated from the writing head, thereby to erase the image from the heat sensitive sheet.

Further, in order to achieve the above described object of the invention, an electronic writing/erasing apparatus according to another aspect of the present invention, for a rewritable heat sensitive sheet, comprising:

a writing unit including a pen-shaped housing and a heat generating head housed in the housing, for generating heat to write an image on the rewritable heat sensitive sheet; and an erasing unit including a housing which is independent of the pen-shaped housing and a heat generating head housed in the independent housing, for generating heat at a temperature which is different from a temperature of heat generated from the writing head, thereby to erase the image from the heat sensitive sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS (First Embodiment)

Figure 1:
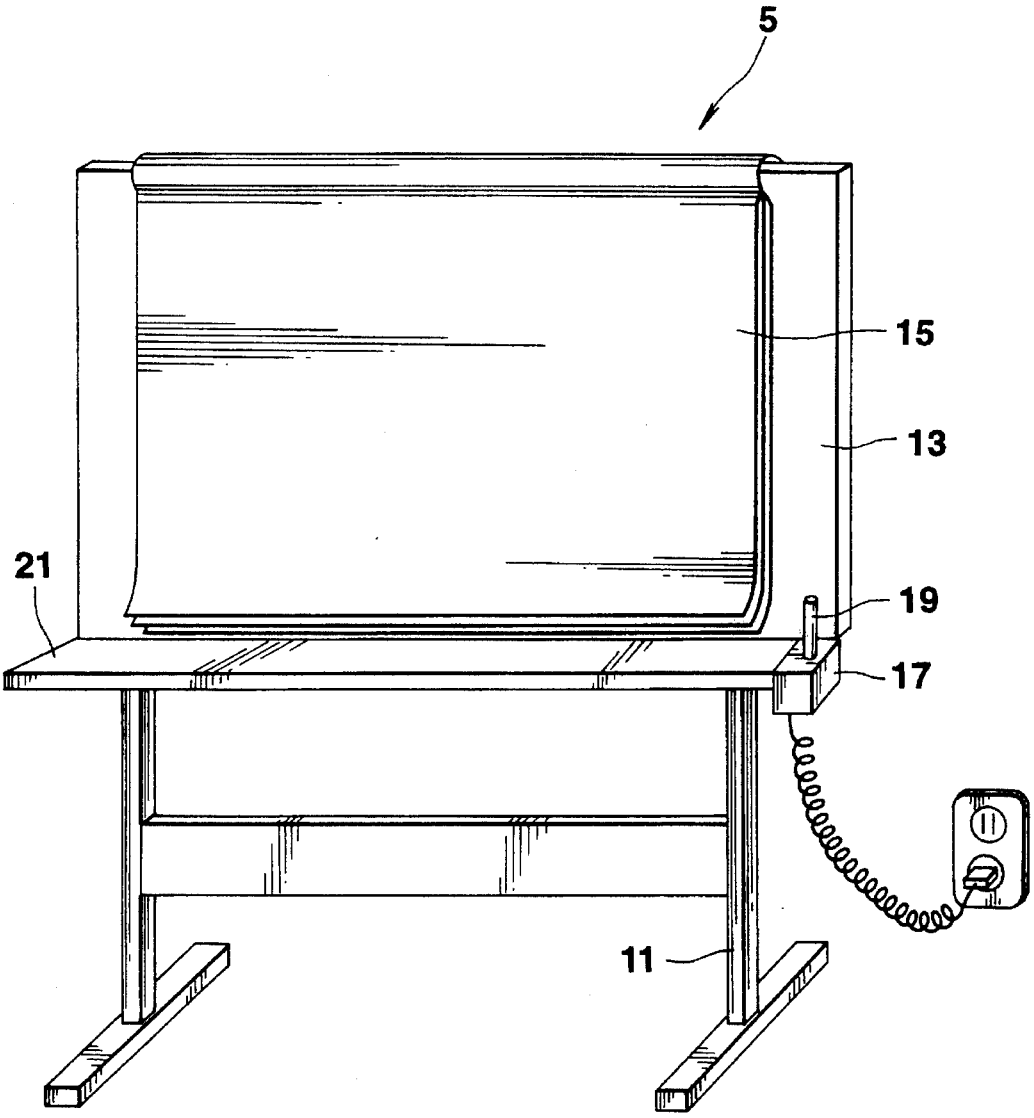
FIG. 1 is a perspective view showing an outer appearance of an electronic blackboard which is used in combination with an electronic writing/erasing apparatus according to a first embodiment of the present invention.

FIG. 1 shows an outer appearance of an electronic blackboard 5 which is used in combination an electronic writing/erasing apparatus according to a first embodiment of the present invention. As shown in FIG. 1, the outer appearance of the blackboard 5 likes to that of a normal movable blackboard or white board, and the blackboard 5 includes a leg portion 11 having casters (not shown) with lock mechanism, a vertical board 13 arranged on the leg portion 11, a plurality of heat sensitive sheets 15 which are placed on a vertical board 13 and whose upper sides are fixed to an upper end portion of the vertical board 13, a charging device 17 arranged at a right lower end of the vertical board 13, a pen-shaped writing/erasing apparatus (electronic pen) 19 placed on the charging device 17, and a small shelf 21 which is arranged along a lower side of the vertical board 13 and on which the electronic pen 19 is placed temporarily.

The heat sensitive sheets 15 have the size of A0 (Japanese Industrial Standard P 0138: 841 mm×1189 mm) or larger and are a type capable of repeatedly writing and erasing an image. For example, each of the heat sensitive sheets can be formed of a macromolecular/low-molecular complex type sheet of thermal reversible material.

Figure 2:
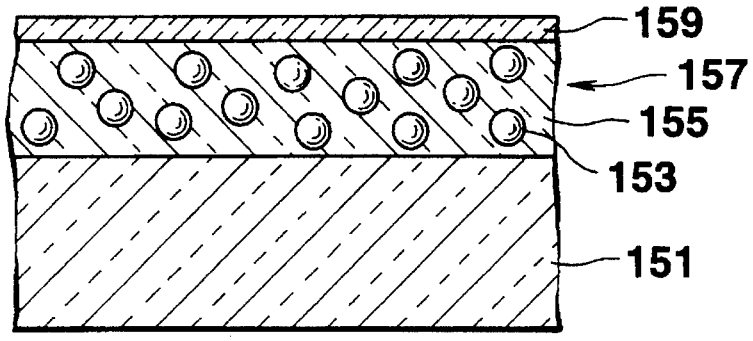
FIG. 2 is a cross-sectional view of a heat sensitive sheet of the electronic blackboard shown in FIG. 1.

As shown in FIG. 2, the macromolecular/low-molecular complex type heat sensitive sheet 15 includes a base sheet 151 constituted by a transparent or colored polyester film and the like, a recording layer 157 arranged on the base sheet 151 and constituted by a resin-made base matrix 155 including particles 153 of organic low-molecular matter such as higher fatty acid, and a transparent protection film 159 arranged on the recording layer 157.

Figures 3A, 3B:
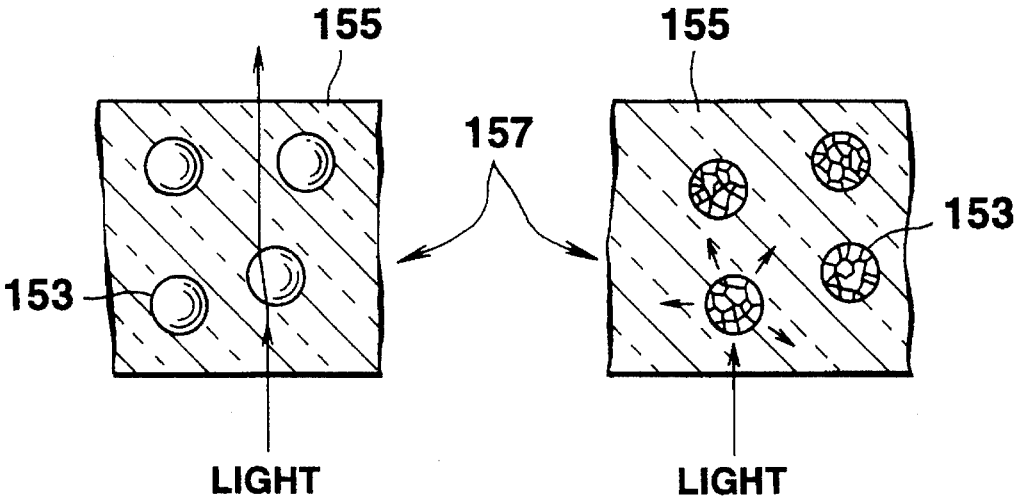
FIG. 3A is an enlarged cross-sectional view of a recording layer of the thermal sheet shown in FIG. 2, in which the recording layer is in a light transmitting state.
FIG. 3B is an enlarged cross-sectional view of the recording layer shown in FIG. 3A, in which the recording layer is in a light scattering state.

In the recording layer 157, as shown in FIG. 3A, each of the particles 153 is considerably large when each of the particles 153 of the organic low-molecular matter is monocrystalline. Therefore, a light can penetrates each of the particles 153 without being scattered, and the layer 157 becomes transparent (that is, the sheet 15 has a high transmittance). In contrast to this, as shown in FIG. 3B, when each of the particles 153 of the organic low-molecular matter is polycrystalline, crystallographic axes of crystals of each of the particles 153 of the organic low-molecular matter extend in many directions. A light entered into each of the particles 153 is thus repeatedly refracted therein and scattered on the interfaces of the crystals, and the recording layer 157 becomes a white hiding (whitely opaque) state (that is, the sheet 15 has a low transmittance). As stated above, an image can be written on the heat sensitive sheets 15 or erased therefrom by controlling the crystal structure of each of the particles 153 of the organic low-molecular matter.

Figure 4:
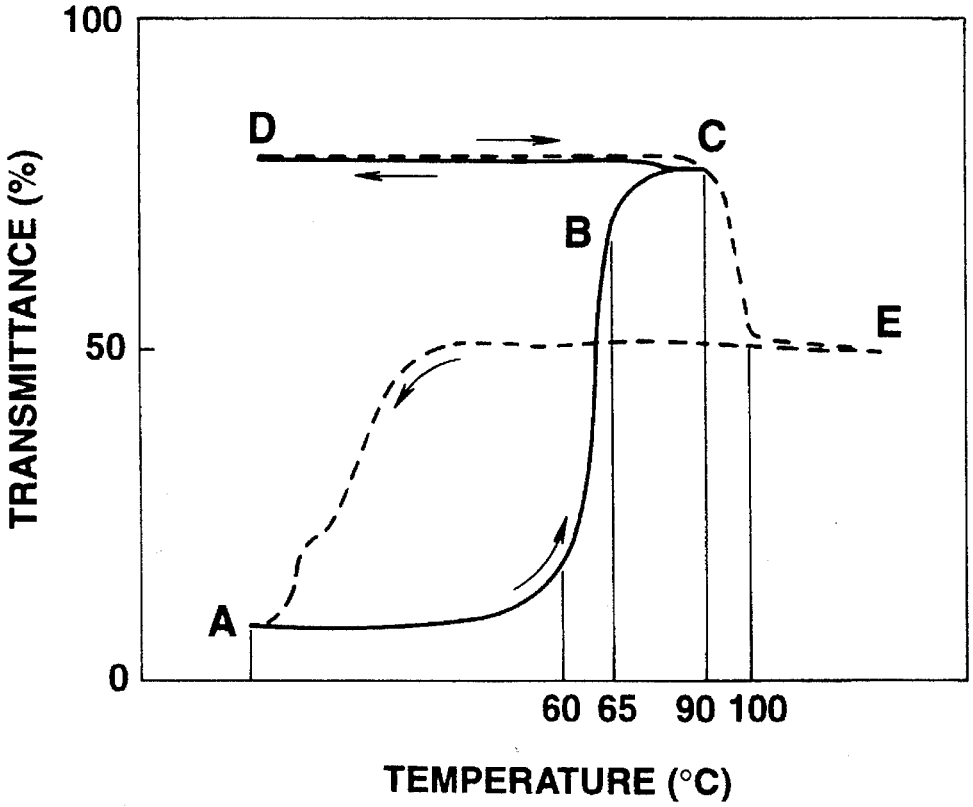
FIG. 4 is a graph showing a relationship between a temperature applied to the heat sensitive sheet of FIG. 2 and a transmittance of the heat sensitive sheet.

FIG. 4 shows an example of a relationship between a temperature applied to the macromolecular/low-molecular complex type heat sensitive sheet 15 and a transmittance thereof. According to this example, the transmittance of the sheet 15 is low when the temperature is normal. If heat of about 65° C. to about 90° C. is added to the above described opaque heat sensitive sheet 15, the transmittance of the sheet 15 increases as indicated by a solid line (A→B→C). And, then, the temperature of the sheet 15 decreases, the transmittance of the sheet 15 does not lower as indicated by the solid line (C→D).

If heat of 100° C. or higher is applied to the above described transparent heat sensitive sheet 15, the transmittance of the sheet 15 decreases to the intermediate value of about 50% as indicated by a dotted line (D→C→E), and then becomes lower as the temperature decreases as indicated by the dotted line (E→A).

If, therefore, the whole of the thermal sheet 15 is once made opaque, an image can be written on the sheet 15 by applying heat of about 90° C. to the sheet 15, and the image which has been written on the sheet 15, can be erased by applying heat of 100° C. or higher to the image on the sheet 15. As described above, the image such as characters, numerals and figures can be repeatedly written on and erased from the heat sensitive sheet 15.

A constitution of an electronic pen (writing/erasing apparatus) 19 for writing image on the thermal sheets 15 having the foregoing characteristics and for erasing the image therefrom, will now be described, with reference to FIG. 5.

Figure 5:
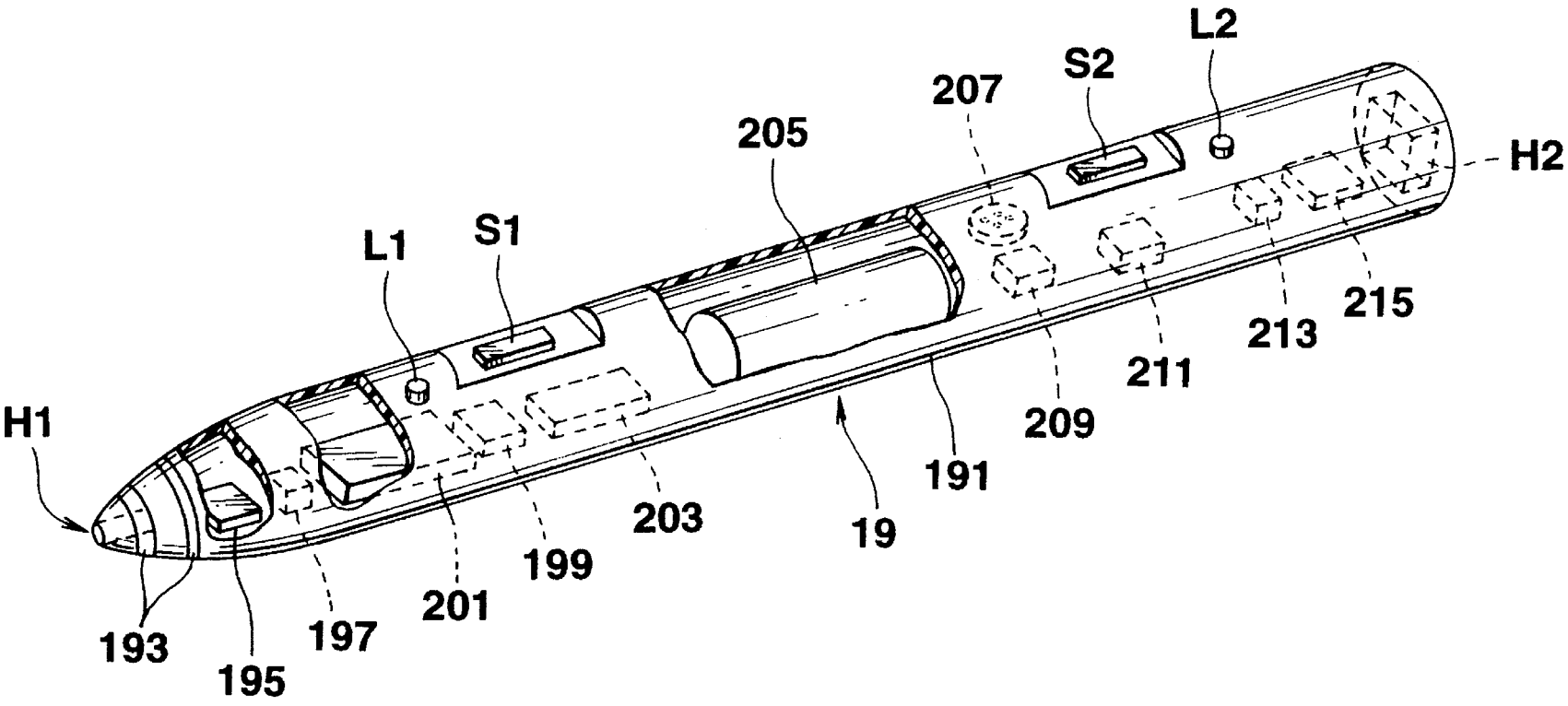
FIG. 5 is a perspective view of a pen-shaped electronic writing/erasing apparatus used in combination with the electronic blackboard shown in FIG. 1, parts of a housing of the apparatus being cut away.

As illustrated in FIG. 5, one end portion of a pen-shaped barrel (housing) 191 tapers as that of a commonly-used pen does, and is provided with a thermal head (referred to as a writing head hereinafter) H1 for writing image and a pair of ring-shaped contact terminals 193.

A write switch S1 and a write-on light L1 are arranged on an outer surface of the barrel 191 at a position near to the tapered end portion. When a user holds the barrel 191 to write images such as characters, numerals and the like, the write switch S1 is depressed (turned on) by a finger of the user, so that the writing head H1 generates heat. The write switch S1 is so located on the outer surface of the barrel 191, that it can be operated easily by the finger of the user when the user holds the barrel 191 of the electronic pen 19. The write-on light L1 is constituted by an LED and the like, and is turned on while the write switch S1 is being depressed. When the write-on light L1 is turned on, the write-on light L1 warns the user that the writing head H1 is generating heat, and prevents the user from burning its fingers.

The other end portion of the barrel 191 is provided with another thermal head (referred to as an erasing head) H2 for erasing the written image. A heat generating area of the erasing heat H2 is larger than that of the writing head H1.

An erase switch S2 and an erase-on light L2 are arranged on the outer surface of the barrel 191 at a position near to the erase switch S2. When the user erases the images, the erase switch S2 is depressed (turned on) by the user, so that the erasing head H2 generates heat. The erase switch S2 is so located on the outer surface of the barrel 191, that it can be operated easily by the finger of the user when the user holds the other end portion of the electronic pen 19. The erase-on light L2 is constituted by an LED and the like, and is turned on while the erase switch S2 is being depressed. When the erase-on light L2 is turned on, the erase-on light L2 warns the user that the erasing head H2 is generating heat, and prevents the user from burning its fingers.

In the barrel 191, a writing head driving circuit 195 for driving the writing head H1, a writing temperature sensing circuit 197 for sensing a temperature of heat generated from the writing head H1, a write-on light driving circuit 199 for driving the write-on light L1, a controller 201, constituted as one chip by a CPU and its peripheral circuit, etc, for controlling the whole operation of the electronic pen 19, a battery charging circuit 203 for charging a chargeable battery (not shown) with electric power supplied through the contact terminals 193, a power source circuit 205, having the chargeable battery, for supplying an operation voltage to the other circuits and components housed in the barrel 191, a buzzer 207, a buzzer driving circuit 209, an erase-on light driving circuit 211 for driving the erase-on light L2, an erasing temperature sensing circuit 213 for sensing a temperature of heat generated from the erasing head H2, and an erasing head driving circuit 215 for driving the erasing head H2, are contained.

Figure 6:
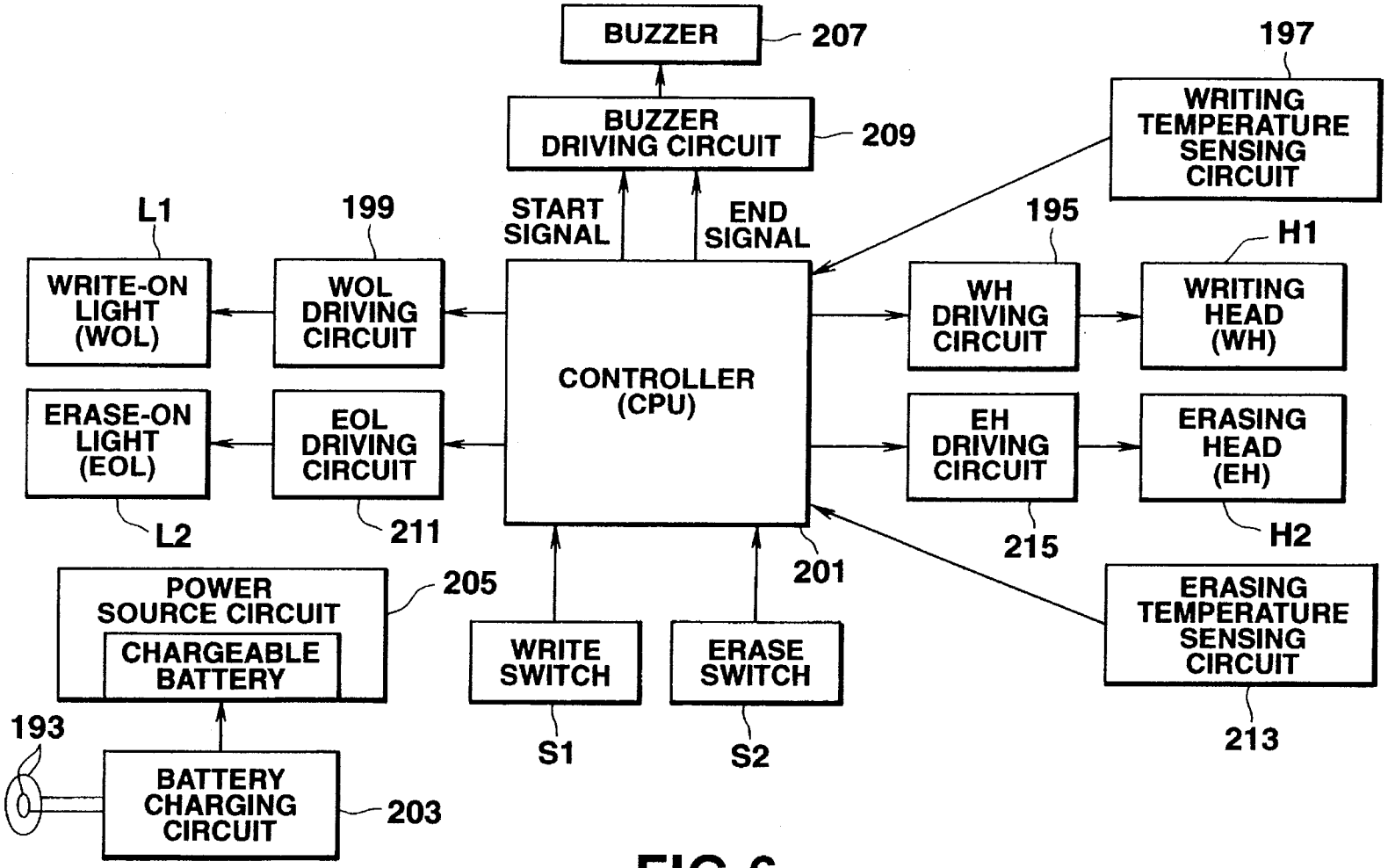
FIG. 6 is a block diagram showing a circuit arrangement of the pen-shaped electronic writing/erasing apparatus shown in FIG. 5.

FIG. 6 shows a block diagram showing a circuit arrangement of the electronic pen 19 having the above-described constitution.

As shown in FIG. 6, on- and off-signals of the write switch S1 and erase switch S2 are supplied to the controller 201.

In response to an on-signal supplied from the write switch S1, the controller 201 controls the writing head driving circuit 195 to turn on the writing head H1, and thus the writing head H1 generates heat. The controller 201 also receives a signal supplied from the writing temperature sensing circuit 197, and controls the writing head driving circuit 195 such that the temperature of the writing head H1 falls within a predetermined range of the writing temperature.

In response to an on-signal supplied from the erase switch S2, the controller 201 controls the erasing head driving circuit 215 to turn on the erasing head H2, and thus the erasing head H2 generates heat. Further, the controller 201 receives a signal supplied from the erasing temperature sensing circuit 213, and controls the erasing head driving circuit 215 such that the temperature of the erasing head H2 falls within a predetermined range of the erasing temperature.

The controller 201 responds to the turnon and turnoff of the write switch S1, and controls the on- and off-states of the write-on light L1 through the write-on light driving circuit 199. The controller 201 also responds to the turnon and turnoff of the erase switch S2, and controls the on- and off-states of the erase-on light L2 through the erase-on light driving circuit 211.

When the write switch S1 or the erase switch S2 is turned on, the controller 201 supplies one start signal and one end signal to the buzzer driving circuit 209 to cause the buzzer 207 to generate a sound of "beep" only one time. When the switch S1 or S2 is turned off, the controller 201 supplies three start signals and three end signals to the buzzer driving circuit 209 to cause the buzzer 207 to generate a sound of "beep" three times.

The battery charging circuit 203 is connected to the contact terminals 193, and charges the chargeable battery of the power source circuit 205 with electric power supplied through the contact terminals 193. The power source circuit 205 generates a voltage from the electric power of the chargeable battery and supplies it to the writing and erasing heads H1 and H2, write-on and erase-on lights L1 and L2, buzzer 207, and the other electronic circuits in order to drive them.

Figure 7:
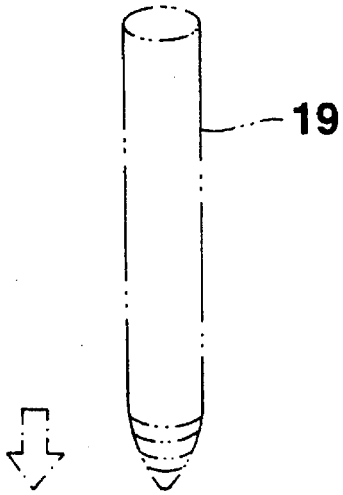
FIG. 7 is a perspective view showing a charging device of the electronic blackboard shown in FIG. 1.
Figure 7:
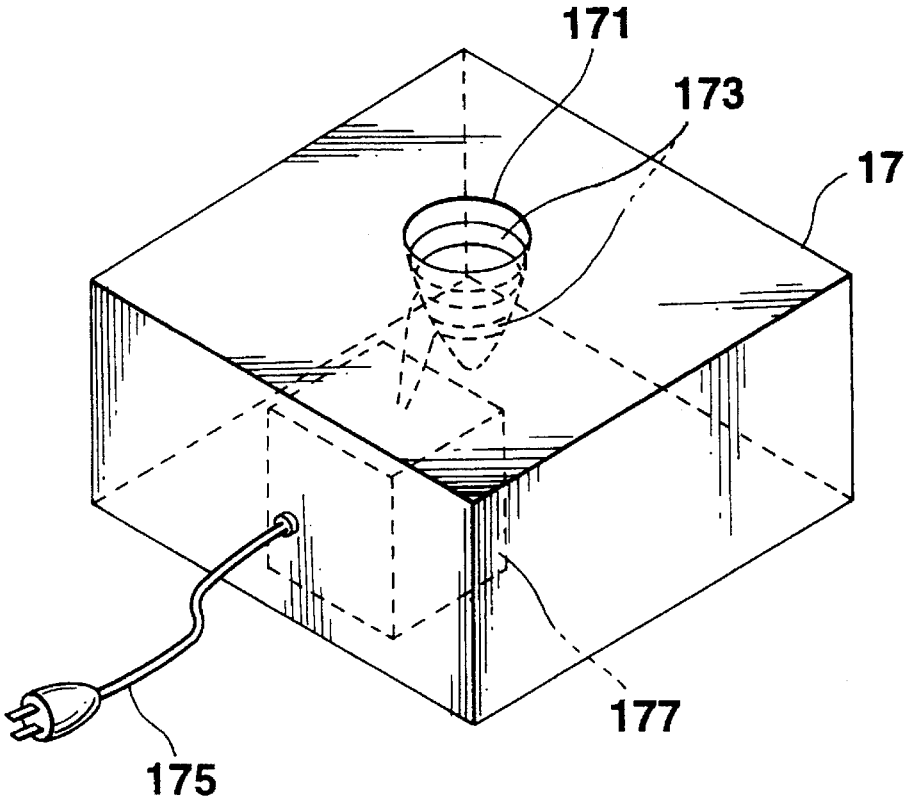

A constitution of the charging device 17 arranged at the right lower end of the vertical board 13, will now be described with reference to FIG. 7. As illustrated in FIG. 7, the charging device 17 includes a tapered receiving hole 171 into which the tapered end portion of the electronic pen 19 is inserted, a pair of ring-shaped contact terminals 173 arranged in the tapered receiving hole 171 and contacting the contact terminals 193 of the electronic pen 19 inserted thereinto, and an AC/DC converter 177, which is connected to a commercial electric power source through a power source cord 175, for rectifying and smoothing AC commercial electric power to generate DC charging electric power and supplying the DC charging electric power to the contact terminals 173.

An operation of the electronic blackboard 5 having the above constitution will now be described, with reference to FIGS. 1 to 8.

In the first embodiment, all of the heat sensitive sheets 15 are once heated to make their temperature increase to 100° C. or higher and then are cooled to make their temperature decrease to the normal one, and the sheets 15 become the white hiding (whitely opaque) state. Therefore, the writing head H1 is heated to a range between 65° C. to 90° C. to render the heat sensitive sheet 15 in the light transmitting state, and the erasing head H2 is heated to 105° C. or higher to render the heat sensitive sheet 15 in the white hiding (whitely opaque) state.

When the electronic pen 19 is not being used, it is set in the charging device 17 with its tapered end portion being inserted into the tapered receiving hole 171 of the charging device 17, as shown in FIGS. 1 and 7. In this state, the commercial AC electric power, which is supplied through the power source cord 175, is converted to DC electric power by the AC/DC converter 177, and the DC electric power is supplied to the battery charging circuit 203 of the electronic pen 19 via the contact terminals 173 and 193 and is charged in the chargeable battery of the power source circuit 205 of the electronic pen 19.

When a user writes images such as characters, numerals, figures and the like on the top heat sensitive sheet 15, the user removes the electronic pen 19 from the charging device 17, then holds it with the writing head H1 downward, and depresses the write switch S1 to turn it on.

Figure 8:
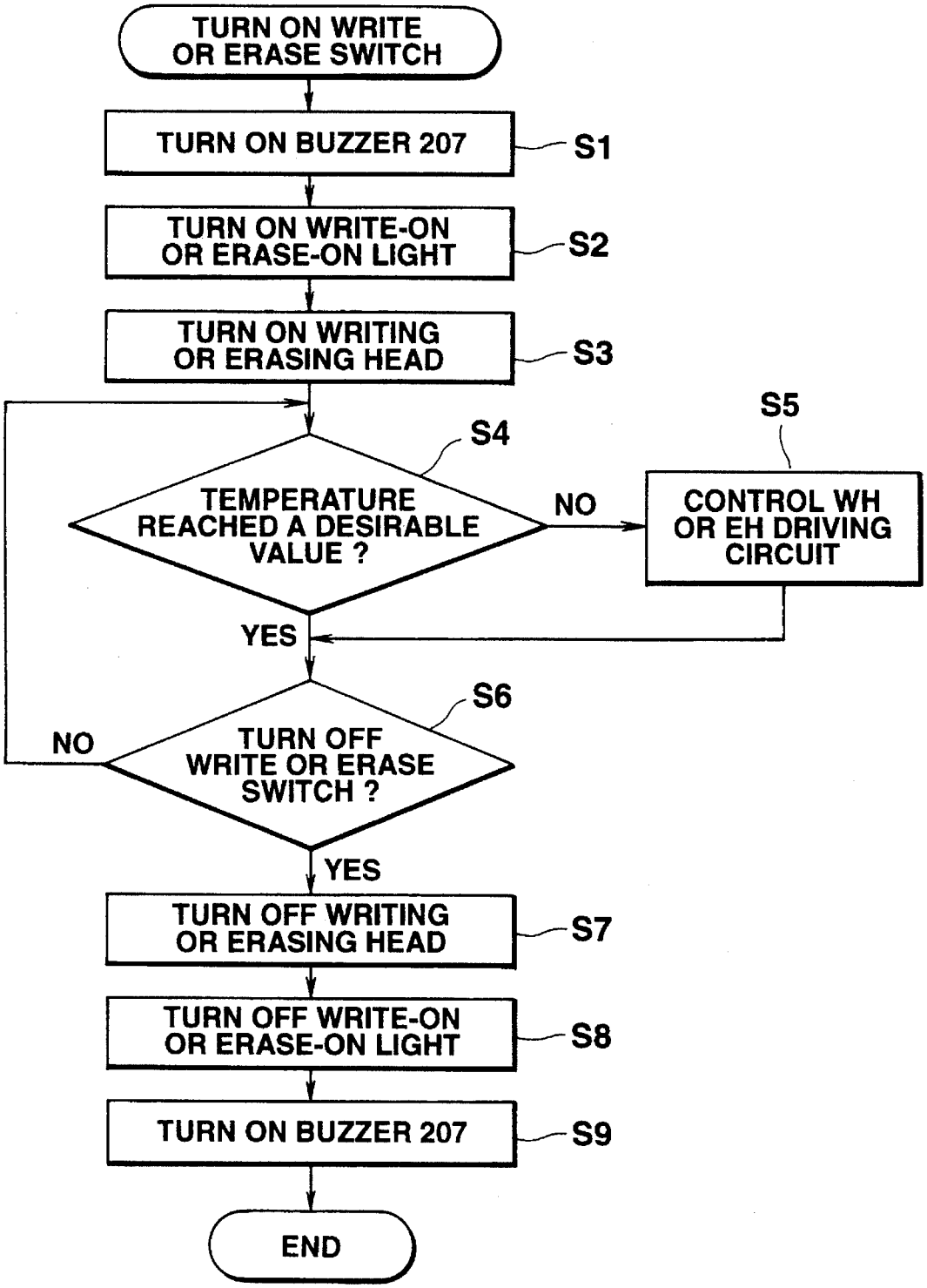
FIG. 8 is a flowchart for explaining an operation of a controller shown in FIGS. 5 and 6.

The controller 201 (shown in FIGS. 5 and 6) senses the turnon of the write switch S1 and starts a process shown in FIG. 8. In the process, at first the controller 201 supplies a start signal to the buzzer driving circuit 209, and then supplies an end signal to the buzzer driving circuit 209 after a predetermined period of time (e.g., 500 msec to 1 sec) have passed, and causes the buzzer 207 to generate a sound of "beep" only one time for informing a user of the start of heat generation of the writing head H1 (step S1). Next the controller 201 transmits a control signal to the write-on light driving circuit 199 to turn on the write-on light L1 (step S2). After that, the controller 201 transmits a control signal to the writing head driving circuit 195 to cause it to start supplying of electric power to the writing head H1 and to make the head H1 generate heat of 80° C. to 90° C. therefrom (step S3). Upon receiving a sensed signal from the writing temperature sensing circuit 197, the controller 201 checks the temperature of heat generated from the writing head H1 (step S4), and controls the amount of electric power supplied to the writing head H1 when the need arises, by using the writing head driving circuit 195 (step S5).

If images such as characters or figures are written on the top heat sensitive sheet 15 by the writing head H1 while the writing head H1 is depressed on the top heat sensitive sheet 15 and the write switch S1 is depressed, the organic low-molecular matter of each of the particles 153 in portions of the top heat sensitive sheet 15 which receives the heat from the writing head H1, becomes monocrystalline as shown in FIG. 3A, and the transmittance of the heat supplied particles 153 increases along the curve indicated by the solid line (A→B→C) of FIG. 4. The transmittance of the heat supplied particles 153 are maintained as indicated by the solid line (C→D) even after the writing head H1 is separated from the top heat sensitive sheet 15 and its temperature returns to the normal one. Therefore, the writing trace of the writing head H1 on the top heat sensitive sheet 15 becomes transparent, and a color of the trace is that of the base film 151 of the heat sensitive sheet 15 and is different from that (white) of the other portion on the top heat sensitive sheet 15.

If, as described above, the user moves the electronic pen 19 with the writing head H1 thereof being pressed on the top heat sensitive sheet 15 while depressing the write switch S1, the user can write images, such as characters, numerals, and figures, of the color of the base film 151 of the heat sensitive sheet 15 on the white field of the top heat sensitive sheet 15.

Since the plurality of heat sensitive sheets 15 are prepared on the vertical board 13, the user can turn the top heat sensitive sheet 15 over the back side of the vertical board 13 to write further images on the next heat sensitive sheet 15 when necessary.

If the user releases the write switch S1, the controller 201 senses the turnoff thereof (step S6), and transmits a control signal to the writing head driving circuit 195 to stop the supplying of electric power to the writing head H1 (step S7). The controller 201 then transmits a control signal to the write-on light driving circuit 199 to turn off the write-on light L1 (step S8). Further, the controller 201 supplies repeatedly a start signal and an end signal to the buzzer driving circuit 209 three times, and causes the buzzer 207 to generate a sound of "beep" three times to indicate the end of heat generation of the writing head H1 (step S9). The processing of the controller 201 is thus completed.

To erase the images such as characters and the like, written on the heat sensitive sheet 15 therefrom, the user holds the electronic pen 19 with the erasing head H2 downward and depresses the erase switch S2.

The controller 201 senses the turnon of the erase switch S2 and starts an operation which is like to that in the turnon of the write switch S1. First, the controller 201 supplies a start signal and an end signal in sequence to the buzzer driving circuit 209 and causes the buzzer 207 to generate a sound of "beep" one time (step S1), and further turn on the erase-on light L2 by using the erase-on light driving circuit 211 (step S2). Then, the controller 201 starts supplying electric power to the erase head H2 through the erasing head driving circuit 215 to make the erase head H2 generate heat of about 105° C. (step S3). Upon receiving a sensed signal from the erasing temperature sensing circuit 213, the controller 201 checks the temperature of heat generated from the erasing head H2 (step S4), and controls the amount of electric power supplied to the erasing head H2 when the need arises, by using the erasing head driving circuit 215 (step S5).

If the user moves the electronic pen 19 along the images which have been written on the heat sensitive sheet 15, with the erasing head H2 thereof being pressed on the images while depressing the erase switch S2, a portion of the images, that is a portion of the heat sensitive sheet 15, which receives the heat from the erasing head H2 makes its transmittance to about 50%. When the temperature of the portion returns to the normal temperature, each of the particles 153 of organic low-molecular matter corresponding to the portion becomes polycrystalline as shown in FIG. 3B, and the transmittance thereof decreases along the curve indicated by the dotted line (E→A) of FIG. 4. Thus, the trace of the erasing head H2 on the images on the heat sensitive sheet 15 becomes the white hiding (whitely opaque) state as does the other region thereon.

If, as described above, the user moves the electronic pen 19 along the images which have been written on the heat sensitive sheet 15, with the erasing head H2 thereof being pressed on the images while depressing the erase switch S2, the user can erase the images from the thermal sheet 15.

If the user releases the erase switch S2, the controller 201 senses the turnoff of the erase switch S2 (step S6) and transmits a control signal to the erasing head driving circuit 215 to stop supplying electric power to the erasing head H2 (step S7). After that, the controller 201 turns off the erase-on light L2 (step S8), and causes the buzzer 207 to generate a sound of "beep" three times (step S9). The processing of the controller 201 ends.

As has been described above in detail, according to the first embodiment of the present invention, since a user need not to use a chalk or a marker pen, the user write or erase an image on or from the heat sensitive sheet 15 without soiling its hands. Since, furthermore, the images can be written on and erased from the heat sensitive sheet 15 repeatedly, no resources are wasted. If the electronic black board is connected to a commercial electric power source, the electronic pen 19 can be electrically charged when it is not used. Therefore, unlike a white board using a marker pen of a volatile ink, an image can be written reliably whenever the need arises, without any troublesome operation such as replacement of pens.

Since the electronic pen 19 has the chargeable battery, an electric power source cord or the like need not be connected to the electronic pen 19, and thus the electronic pen 19 can be handled easily. If the electronic pen 19 is set in the tapered receiving hole 171 of the charging device 17 after the electronic pen 19 is used, it is charged automatically. It can thus be used easily, without any special charging operation. Since the heat generating area of the erasing head H2 (which contacts the heat sensitive sheet 15) is larger than that of the writing head H1, the image erasing operation is easy. Since the buzzer 207 and the write-on and erase-on lights L1 and L2 warn a user that the writing or erasing head H1 or H2 is generating heat, a danger to the user, such as a burn, can be reduced.

(Second Embodiment)

In the first embodiment, the erasing head H2 is provided at one end of the electronic pen 19. The diameter of the barrel 191 of the electronic pen 19 is not so large, and thus the erasing head H2 provided on the electronic pen 19 is unsuitable for erasing an image written in a large area on the heat sensitive sheet 15. The second embodiment therefore provides a writing/erasing apparatus having a writing unit which is the same as the electronic pen 19 of the above described first embodiment, and an erasing unit which is independent of the writing unit and can easily erasing the image written in a large area on the heat sensitive sheet, for a short time, such as a chalk eraser.

Figure 9:
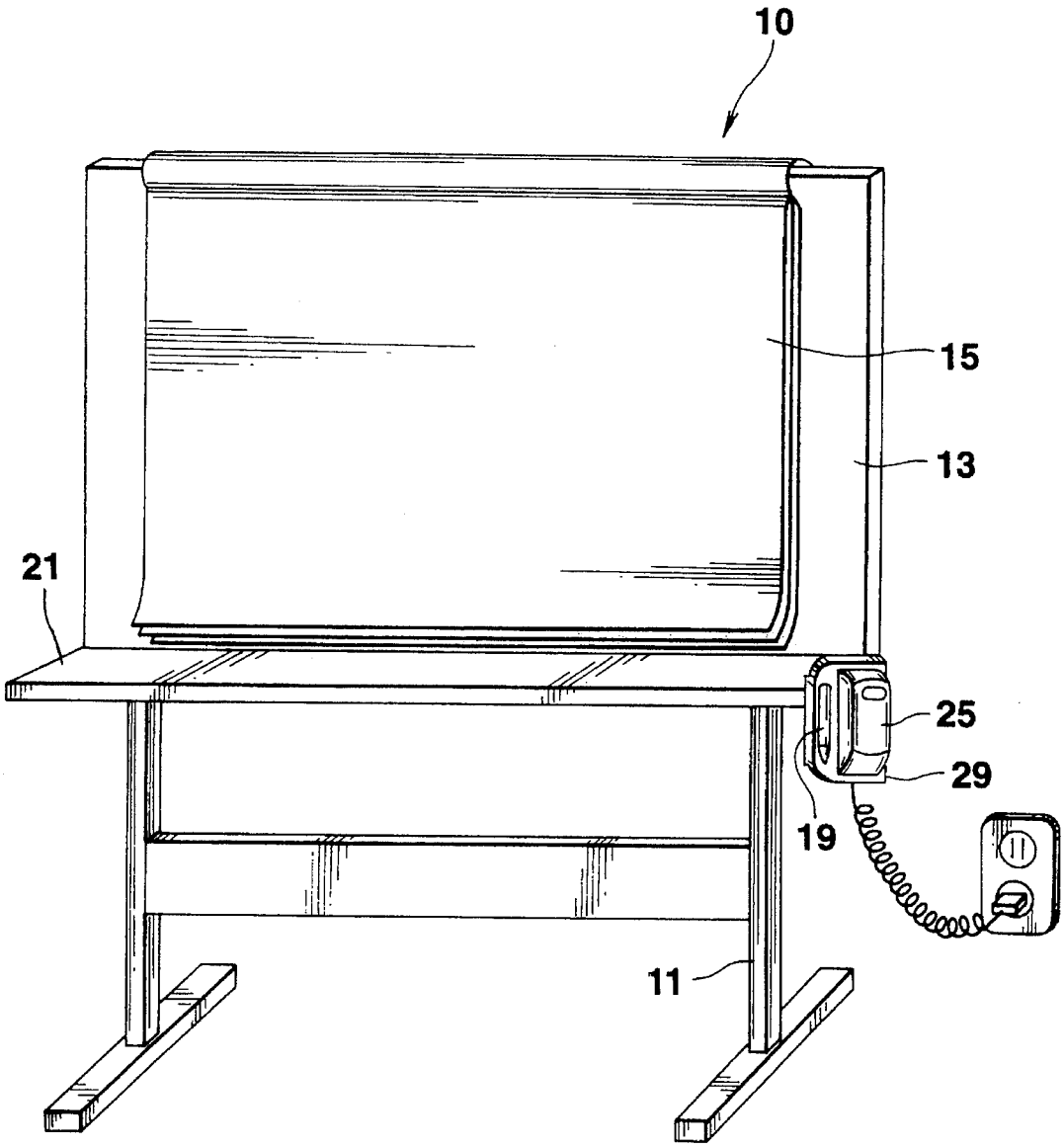
FIG. 9 is a perspective view showing an outer appearance of an electronic blackboard which is used in combination with an electronic writing/erasing apparatus according to a second embodiment of the present invention.

FIG. 9 shows an outer appearance of an electronic blackboard which is used in combination with an electronic writing/erasing apparatus according to the second embodiment of the present invention. As is apparent from FIG. 9, the structure of the electronic blackboard 10 is basically the same as that of the electronic blackboard 5 shown in FIG. 1, except that the blackboard 10 includes a charging device 29 for electrically charging the electronic pen (writing unit) 19 and an erasing unit 25. In FIG. 9, the same structural elements as those in FIG. 1 are denoted by the same reference numerals as those used in FIG. 1 and their descriptions are omitted.

Figure 10:
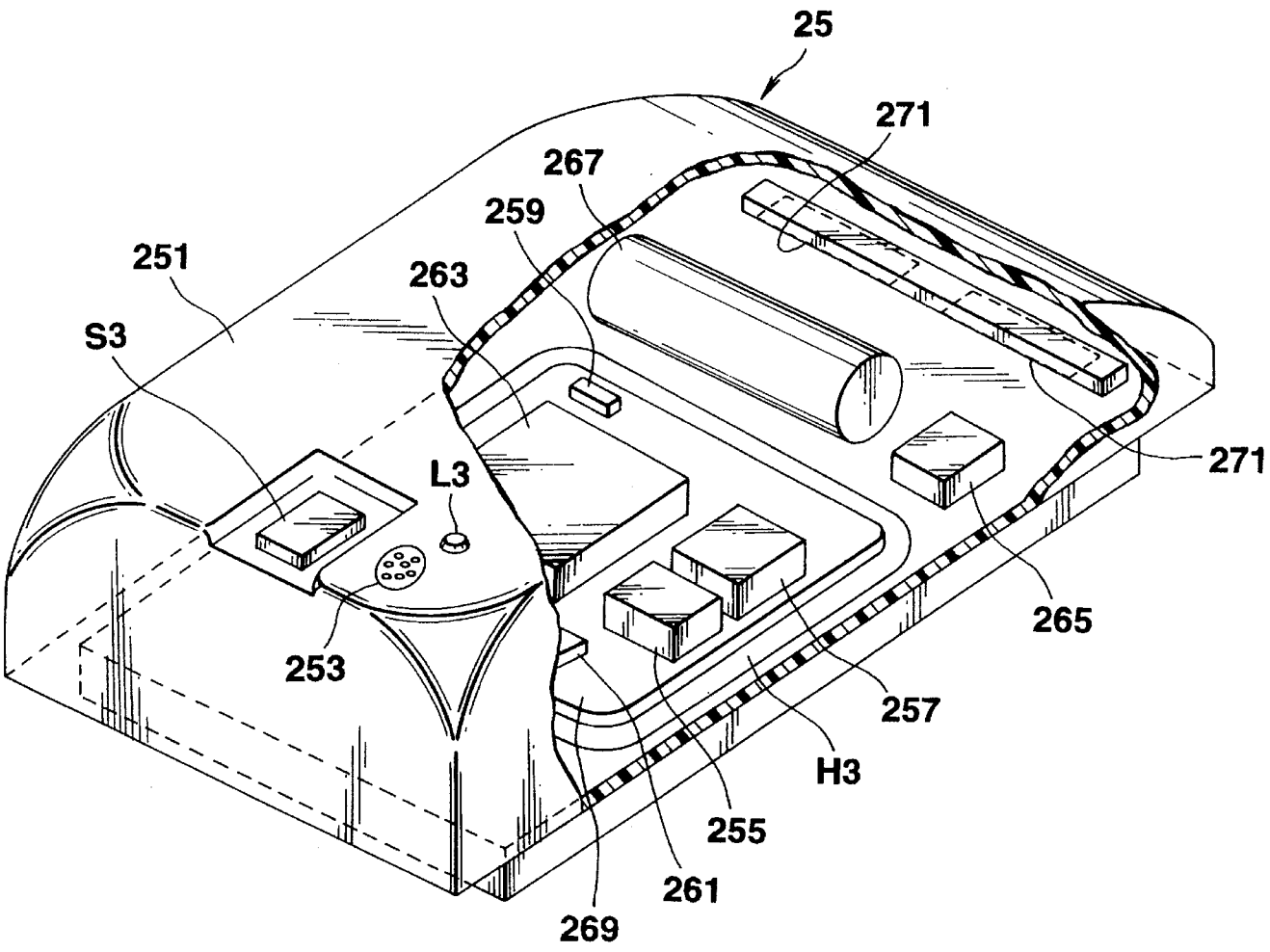
FIG. 10 is a perspective view showing an erasing unit of the writing/erasing apparatus shown in FIG. 9.
Figure 11:
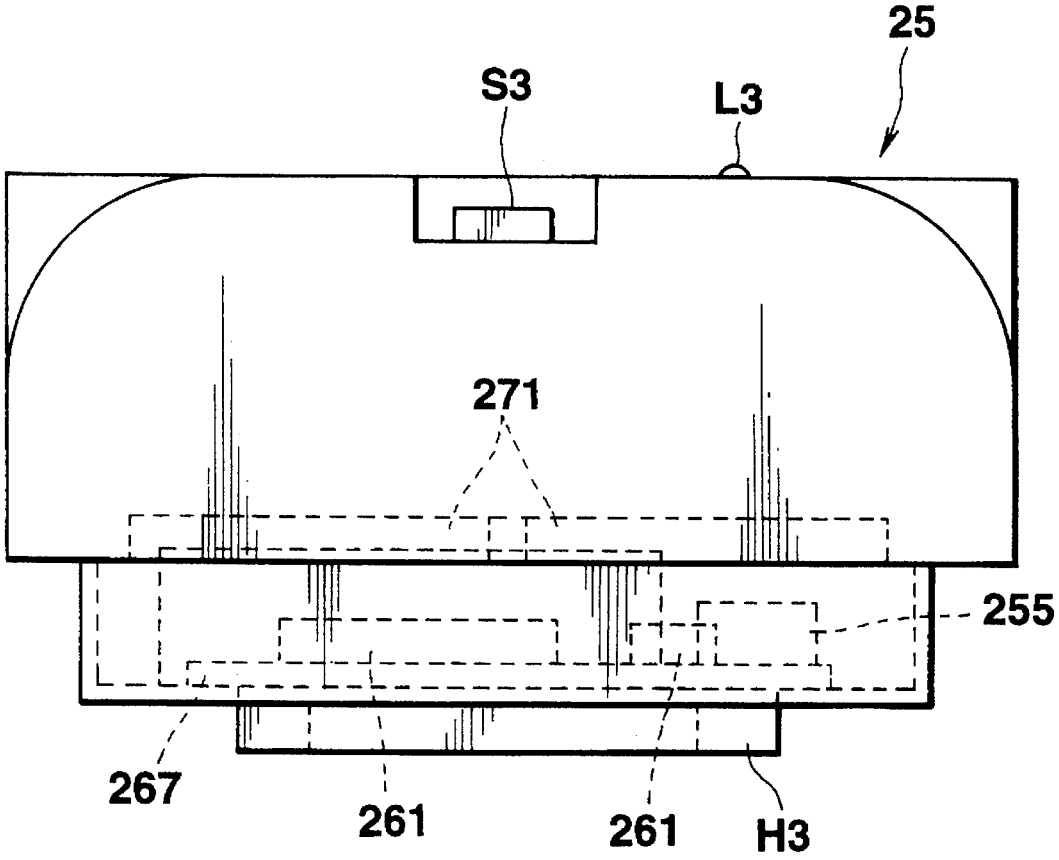
FIG. 11 is a side view of the erasing unit of the writing/erasing apparatus shown in FIG. 9.

FIGS. 10 and 11 show a constitution of the erasing unit 25, more specifically FIG. 10 is a perspective view showing the erasing unit 25, and FIG. 11 is a side view of the erasing unit 25.

As shown in FIGS. 10 and 11, like a conventional chalk eraser, etc., the erasing unit 25 has a case 251 which is suitable to be held by a hand of a user. A switch S3, a light L3 and a buzzer 253 are arranged on an upper surface of the case 251, and a frame-shaped thermal head (an erasing head) H3 and a pair of contact terminals 271 are arranged on a lower surface of the case 251.

In the case 251, an erasing head driving circuit 255, a temperature sensing circuit 257 for sensing a temperature of the erasing head H3, a light driving circuit 259 for driving the light L3, a buzzer driving circuit 261, a controller 263, a charging circuit 265, an electric power source circuit 267 having a chargeable battery, and a circuit board 269, are contained.

The erasing head driving circuit 255, the temperature sensing circuit 257, the light driving circuit 259, the buzzer driving circuit 261, and the controller 263 are arranged on the circuit board 269.

A circuit arrangement of the erasing unit 25 shown in FIGS. 10 and 11 is substantially the same as that of FIG. 6 excepting that the circuits concerning the writing operations are deleted.

Figure 12:
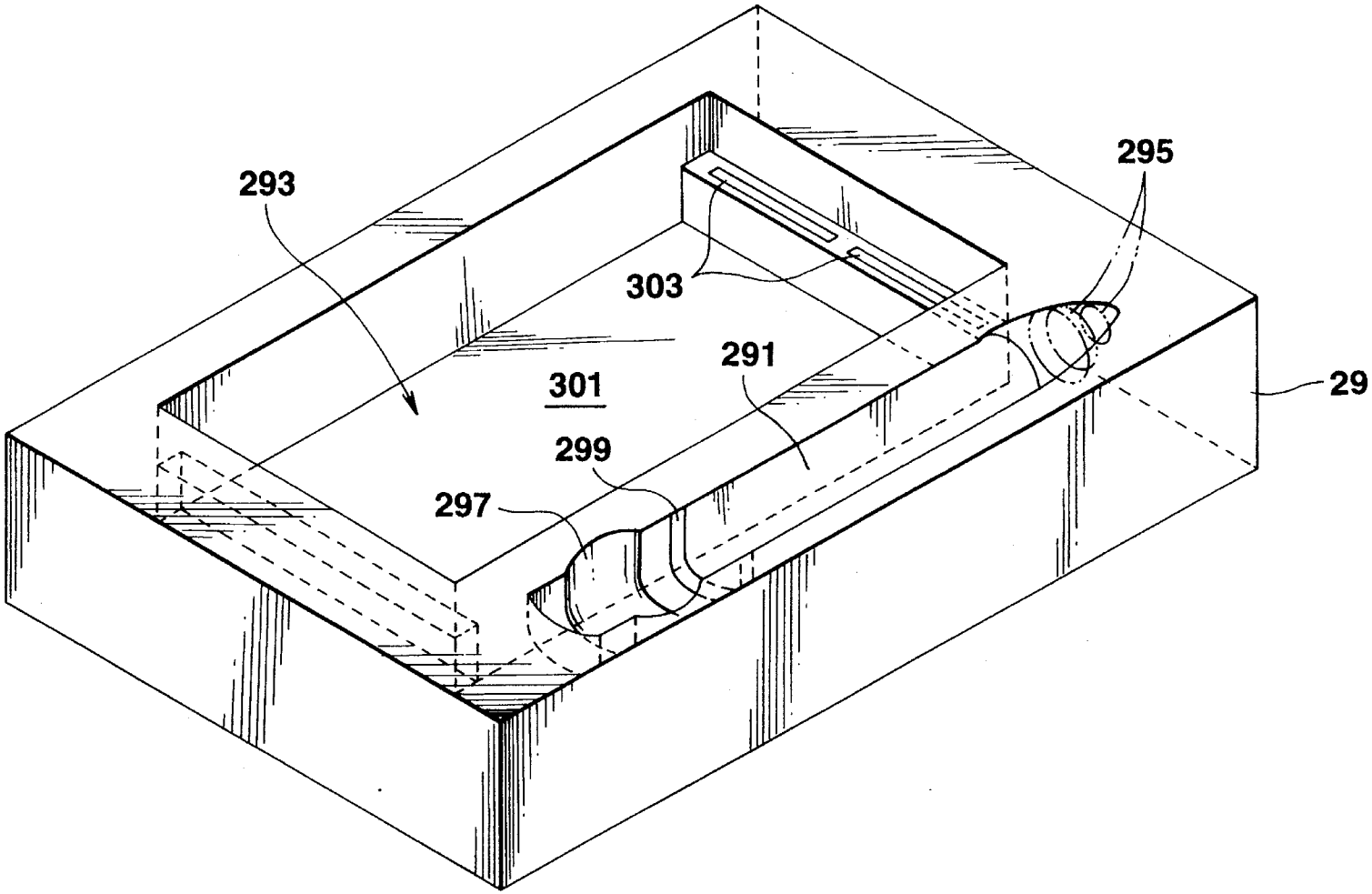
FIG. 12 is a perspective view of a charging device of the electronic blackboard shown in FIG. 9.

The charging device 29 shown in FIG. 9 comprises an electronic pen receiving indent 291 for receiving the electronic pen (writing unit) 19 and an erasing unit receiving indent 293 for receiving the erasing unit 25, as is illustrated in FIG. 12. The electronic pen receiving indent 291 is so designed that the tapered end portion of the pen 19 is inserted firstly into a tapered lower end portion of the indent 291 and then the other portion of the electronic pen 19 is received in the other semicircular-sectioned portion of the indent 291. A pair of contact terminals 295 for contacting the a pair of contact terminals 193 of the electronic pen 19 are arranged in the tapered lower end portion of the indent 291, and a cutaway portion 297 for easily removing the pen 19 from the receiving indent 291 and a magnet 299 for holding the pen 19 in the indent 291 are provided in the other semicircular-sectioned portion of the indent 291.

The erasing unit receiving indent 293 includes an erasing head receiving portion 301 for receiving the frame-shaped erasing head H3 on the lower surface of the case 251 of the erasing unit 25, a pair of contact terminals 303 for contacting the pair of contact terminals 271 on the lower surface of the case 251 of the erasing unit 25 when the erasing unit 25 is held in the indent 293, and a magnet (not shown) for fixing the erasing unit 25 in the indent 293 of the charging device 29.

The charging device 29 further includes an AC/DC converter (not shown), and supplies an electric power for charging to the electronic pen 19 and erasing unit 25 through the contact terminals 295 and 303.

In the second embodiment, too, a user can write an image on the heat sensitive sheet 15 by means of the writing head H1 of the electronic pen 19 and erase the image which have been written on the heat sensitive sheet 15, from the sheet 15 by means of the erasing head H2 of the electronic pen 19.

When the user erases the image which have been written on a large area on the sheet 15, the user removes the erasing unit 25 from the charging device 29 and turns on the switch S3.

The controller 263 senses the turnon of the switch S3, causes the buzzer 253 to generate a sound of "beep" one time through the buzzer driving circuit 261, and turns on the light L3 through the light driving circuit 259, as in the case where the erase switch S2 of the electronic pen 19 of the first embodiment is turned on.

The controller 263 then supplies a control signal to the erasing head driving circuit 255 to make it start supply electric power to the erasing head H3. The erasing head H3 thus generates heat of about 100° C. to about 120° C. The controller 263 monitors the temperature of the erasing head H3 by using the temperature sensing circuit 257, and controls the erasing head driving circuit 255 such that the monitored temperature falls within the above range.

If the user moves the erasing unit 25 with the erasing head H3 being pressed on the image which have been written on the heat sensitive sheet 15 while depressing the erase switch S3, the image (that is, a portion of the heat sensitive sheet 15 which receives heat from the erasing head H3) decreases its transmittance as shown in FIG. 4 by the dotted line (D→C→E→A), and the written image are erased from the heat sensitive sheet 15.

If the user releases the switch S3, the controller 263 controls the erasing head driving circuit 255 to make it stop supplying electric power to the erasing head H3 and turns off the light L3 through the light driving circuit 259, and causes the buzzer 253 to generate a sound of "beep" three times through the buzzer driving circuit 261. The processing of the controller 263 is thus completed.

As has been described above in detail, according to the erasing unit 25 of the writing/erasing apparatus of the second embodiment, even if the image have been written on the large area on the heat sensitive sheet 15, such image can easily be erased for a short time.

Since the erasing head H3 is shaped like a frame, the electric power for keeping the erasing head H3 to a predetermined temperature can be decreased. Further, since an outer exposed area of the erasing head H3 is small, the head can be improved in safety and decreases in danger, such as a burn. Further, a cost needed for manufacturing the erasing head H3 can be lowered.

According to the present invention, the shape of the thermal head is not limited to those of the thermal heads H1, H2 and H3. The shapes thereof can be replaced with arbitrary ones. For example, the erasing head H2 can be formed like a circular ring or the erasing head H3 can be formed like a flat plate.

In the above embodiments, the heat sensitive sheets 15 are entirely in the white hiding (whitely opaque) state when the temperature of the sheets 15 is normal one, the writing head H1 generates heat having such a temperature as to make the sheets 15 transparent, and the erasing heads H2 and H3 generate heat having such a temperature as to return the heat sensitive sheets 15 to the white hiding state. On the contrary to this, the heat sensitive sheets 15 can be made to be transparent when the temperature of the sheets 15 is normal one, to be in white hiding state at a portion thereof where the writing head H1 generating heat of a predetermined temperature contacts, and to be returned to transparent at a position thereof where the erasing heads H2 or H3 contacts while the erasing heads H2 and H3 are generating heat of a predetermined temperature which is different from that generated from the writing head H1.

Furthermore, the writing head H1 and erasing heads H2 and H3 can be switched to generate heat having temperatures which are different from the above described predetermined temperatures thereof, so that these heads H1, H2, H3 can be applied to a heat sensitive sheet which react to the temperatures other than the above described predetermined temperature to change a color thereof.

The constitution and characteristics of the heat sensitive sheets 15 is not limited to those shown in FIGS. 2 to 4. If writing and erasing of image can be repeated by using a heat generating head, a heat sensitive sheet having different constitution and characteristics can be used.

In the above embodiments, the plurality of heat sensitive sheets 15 are arranged on the vertical board 13. The vertical board 13, however, can be made for example to be rotatable in a vertical direction and further two heat sensitive sheets 15 can be attached to both sides of the rotatable vertical board 13, so that the both heat sensitive sheets 15 can be used alternately by rotating the board 13 when the need arises. Furthermore, a hand written image display device such as the black board is not limited to the removable one as described above. The hand written image display device can be a fixed one fixed on the wall of a room.

In the above embodiments, the writing head H1 and erasing heads H2 and H3 are exposed directly to outside. A heat resistant cover, however, can be applied to each of these heads, or a safety device, which makes these heads generate heat only when the heads are pressed on the heat sensitive sheet 15, can be provided.

Further, the electronic pen 19 used in the second embodiment can not be provided with the erasing head H2.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electronic writing/erasing apparatus for a rewritable heat sensitive sheet, comprising:

a pen-shaped housing;

a heat generating writing head housed in one end portion of the housing, for generating heat to write an image on the rewritable heat sensitive sheet; and a heat generating erasing head housed in a portion of the housing other than the one end portion in which the writing head is housed, for generating heat at a temperature which is different from a temperature of heat generated from the writing head, thereby to erase the image from the heat sensitive sheet.

2. An electronic writing/erasing apparatus according to claim 1, wherein:

the housing includes first and second switches arranged thereon to be operated by a user when the user uses the apparatus;

the writing head generates heat when the first switch is turned on; and the erasing head generates heat when the second switch is turned on.

3. An electronic writing/erasing apparatus according to claim 2, wherein said housing portion where said erasing head is housed is the other end of the pen-shaped housing.

4. An electronic writing/erasing apparatus according to claim 1, further comprising means for warning a user that one of the writing and erasing heads is generating heat.

5. An electronic writing/erasing apparatus according to claim 1, wherein an area of the erasing head which contacts the heat sensitive sheet is larger than an area of the writing head which contacts the heat sensitive sheet.

6. An electronic writing/erasing apparatus according to claim 1, further comprising a chargeable battery which is charged with an external electric power source and supplies electric power to the writing and erasing heads.

7. An electronic writing/erasing apparatus according to claim 1, wherein the heat sensitive sheet is supported by a supporting plate.

8. An electronic writing/erasing apparatus according to claim 1, wherein said housing portion where said erasing head is housed is the other end of the pen-shaped housing.

9. An electronic writing/erasing apparatus for a rewritable heat sensitive sheet, comprising:

a writing unit including a pen-shaped housing and a heat generating writing head housed in an end portion of the housing, for generating heat to write an image on the heat sensitive sheet; and an erasing unit including a housing which is independent of the pen-shaped housing and a heat generating erasing head housed in the independent housing, for generating heat at a temperature which is different from a temperature of heat generated from the writing head, thereby to erase the image from the heat sensitive sheet.

10. An electronic writing/erasing apparatus according to claim 9, wherein the erasing head has a frame-like shape.

11. An electronic writing/erasing apparatus according to claim 9, wherein:

the independent housing of the erasing unit has a size and shape which allow a user to hold the independent housing, and a switch arranged on the independent housing to be operated by the user; and the erasing head generates heat only when the switch is turned on.

12. An electronic writing/erasing apparatus according to claim 9, wherein the erasing unit includes means for warning a user that the erasing head is generating heat.

13. An electronic writing/erasing apparatus according to claim 9, wherein an area of the erasing head which contacts the heat sensitive sheet is larger than an area of the writing head which contacts the heat sensitive sheet.

14. An electronic writing/erasing apparatus according to claim 9, wherein the erasing unit includes a chargeable battery which is charged with an external electric power source and supplies electric power to the erasing head.

15. An electronic writing/erasing apparatus according to claim 9, wherein the writing unit further includes another heat generating erasing head housed in a portion of the housing other than the end portion in which the writing head is housed, for generating heat at a temperature which is different from a temperature of heat generated from the writing head, thereby to erase the image from the heat sensitive sheet.

16. An electronic writing/erasing apparatus according to claim 15, wherein said housing portion where said another heat generating erasing head is housed is the other end of the housing the writing unit.

* * * * *